US005315945A

United States Patent [19]

Nakano

[11] Patent Number: 5,315,945

[45] Date of Patent: May 31, 1994

[54] APPARATUS AND METHOD FOR THREAD SUPPLYING IN A CHAIN STITCH SEWING MACHINE

[75] Inventor: Minoru Nakano, Osaka, Japan

[73] Assignee: Pegasus Sewing Maching Mfg. Co., Ltd., Osaka, Japan

[21] Appl. No.: 903,938

[22] Filed: Jun. 26, 1992

[30] Foreign Application Priority Data

Jun. 28, 1991 [JP] Japan ..... 3-158114

[51] Int. Cl.[5] ..... D05B 1/10; D05B 47/04

[52] U.S. Cl. ..... 112/262.1; 112/165; 112/199; 112/255; 112/302; 112/121.11

[58] Field of Search ..... 112/262.1, 302, 255, 112/254, 163, 165, 166, 199, 121.11

[56] References Cited

U.S. PATENT DOCUMENTS

| | | | |
|---|---|---|---|
| 3,301,206 | 1/1967 | Lanzendorfer | 112/199 |
| 4,690,083 | 9/1987 | Hara et al. | 112/254 |
| 4,932,346 | 6/1990 | Matsubara et al. | 112/302 X |
| 4,967,679 | 11/1990 | Hara et al. . | |
| 5,056,446 | 10/1991 | Nakano et al. | 112/302 |
| 5,186,114 | 2/1993 | Ikawa | 112/254 |

FOREIGN PATENT DOCUMENTS

| | | |
|---|---|---|
| 264515 | 4/1988 | European Pat. Off. . |
| 3232813 | 3/1984 | Fed. Rep. of Germany . |
| 61-180683 | 11/1986 | Japan . |
| 1-192391 | 8/1989 | Japan . |
| 4-2394 | 1/1992 | Japan . |

*Primary Examiner*—Peter Nerbun

*Attorney, Agent, or Firm*—Wegner, Cantor, Mueller & Player

[57] ABSTRACT

An apparatus and a method for supplying thread in a chain stitch sewing machine are disclosed, the apparatus comprising a needle vertically reciprocating between a top end point and a bottom end point in one sewing cycle; a looper horizontally reciprocating in one sewing cycle; a thread supply device for forcibly supplying a needle thread to the needle; and a thread supply control device for controlling the thread supply device so that the needle thread is supplied in at least two periods in each sewing cycle, the periods being discontinuous.

13 Claims, 7 Drawing Sheets

Fig. 3a 0° 360°
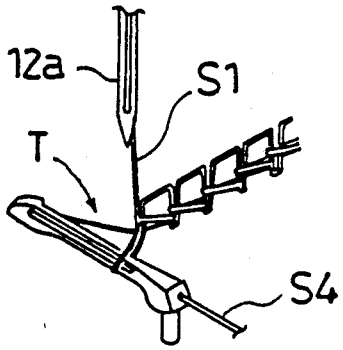
Fig. 3d 130°
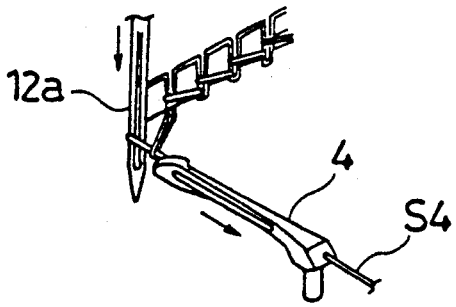
Fig. 3b 70°
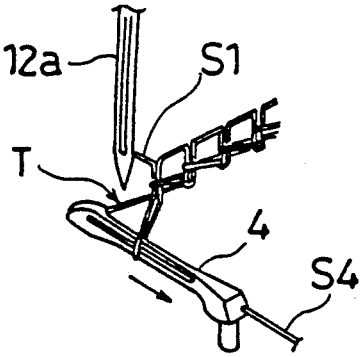
Fig. 3e 180°
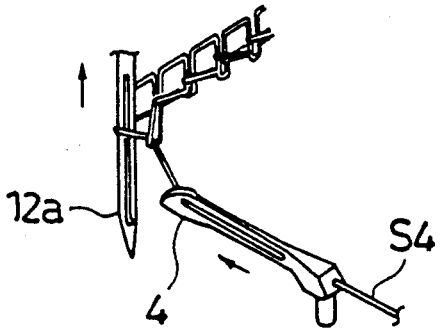
Fig. 3c 90°
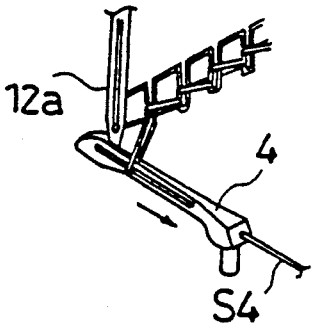
Fig. 3f 220°
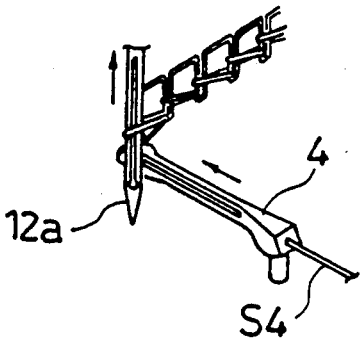

APPARATUS AND METHOD FOR THREAD SUPPLYING IN A CHAIN STITCH SEWING MACHINE

BACKGROUND OF THE INVENTION (1) Field of the Invention

This invention relates to an apparatus and method for supplying thread in a chain stitch sewing machine that produces over-edging stitches, double chain stitches and other stitches composed of needle and looper threads, in which at least a needle thread is forcibly supplied.

(2) Description of the Related Art

In a chain stitch sewing machine, a needle thread supplied to a needle with too high tension may cause puckering of the sewn fabric, especially a thin fabric. In contrast, a needle thread supplied without tension may cause skip stitches by the loose loops the thread forms.

To avoid such problems, the tension of the needle thread is controlled by a thread tension regulator.

However, the above tension applied to the needle thread greatly varies according to the movement of the needle because the tension is produced by the needle thread, which extends to the needle drop point, being pulled out against the friction with the thread tension regulator. Therefore, the thread tension regulator is not easily adjusted so that good sewing results can be obtained.

On the other hand, proposed in U.S. Pat. No. 5056446 is an automatic thread supply device by which a thread is forcibly supplied, and the supply length of the thread is controlled by electrifying/de-electrifying a solenoid. According to this approach, the thread tension is substantially made zero by the thread being supplied forcibly, and consequently, loosening of the needle thread is avoided by supplying the predetermined length of thread needed to form a stitch. Thus, puckering, skip stitches, and other problems can be decreased.

However, the inventors of this invention have found out it is difficult to obtain stable, good sewing results under different sewing conditions, such as differing thickness of fabrics, by the above approach. After various experiments, the timing of applying the thread tension has proved to greatly affect the sewing appearance.

SUMMARY OF THE INVENTION

The object of this invention is to provide an apparatus and method for supply thread in a chain stitch sewing machine which seldom causes puckering, skip stitches, and other problems.

The above object can be achieved by a method for supplying thread in of a chain stitch sewing machine having an apparatus for supplying thread which forcibly supplies a needle thread to a needle, the method being characterized in that each sewing cycle has at least two periods in which the thread is supplied, the periods being discontinuous.

The above object can be achieved by an apparatus for supplying thread in a chain stitch sewing machine, comprising a needle vertically reciprocating between a top end point and a bottom end point in one sewing cycle; a looper horizontally reciprocating in one sewing cycle; a thread supply device for forcibly supplying a needle thread to the needle; and a thread supply control device for controlling the thread supply device so that the needle thread is supplied in at least two periods in each sewing cycle, the periods being discontinuous.

According to the above construction, the tension of the needle thread can be kept low during the first and second periods in which the thread is supplied and until it the thread supplied during the periods has been used. The tension can be keep properly high during the remaining periods. Consequently, the proper amount of needle thread is smoothly supplied to form good stitches, and the formed stitches are appropriately tightened, which results in good sewing appearance even under different sewing conditions.

The first period in each sewing cycle can be from the time the needle begins to enter a triangle formed by a looper, a looper thread and the needle thread, to the time the tip of the looper begins to leave the needle. The second period in each sewing cycle can be from the time the looper begins to enter the loop formed by the needle thread while the needle is rising from a bottom end point, to the time the rising needle reaches as a predetermined height. According to the above conditions, the needle moves without the supply of the needle thread after the needle thread is supplied while the needle is in the middle of its patch to the bottom end point or to the top end point. The tension caused by the balance between the needle thread and the looper thread maintains the regular triangle formed in every sewing cycle. Consequently, the wrinkling of fabrics to be sewn can be minimized and good sewing results can be obtained even for easily wrinkled fabrics such as georgette or broad cloth without puckering, skip stitches, or other problems.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings:

FIGS. 3*a–f* show illustrations of sewing process in accordance with the movement of the needle and the a looper.

DESCRIPTION OF THE PREFERRED EMBODIMENT

Figure 1:
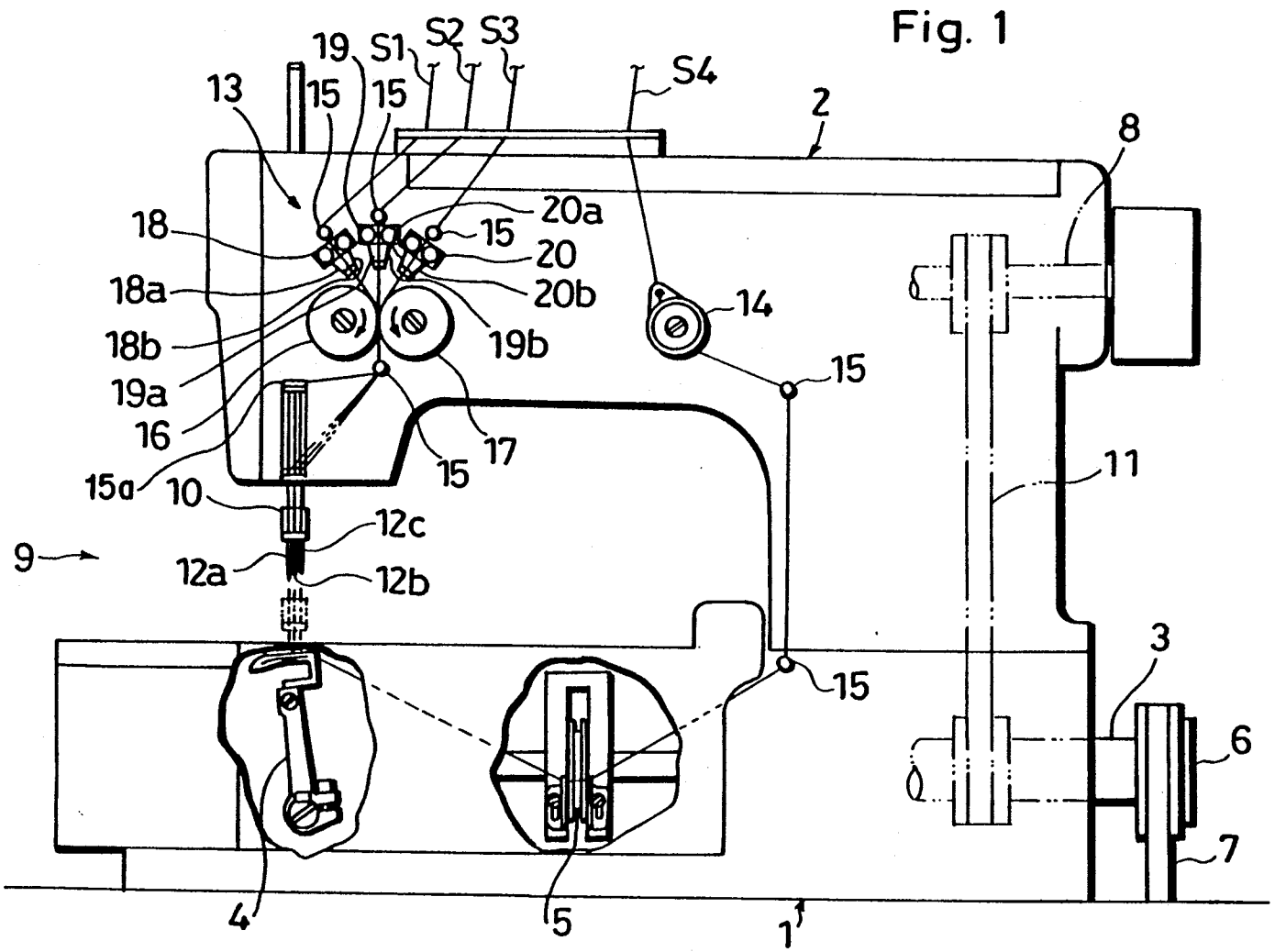
FIG. 1 shows a front view of a chain stitch sewing machine of the present invention.

As shown in FIG. 1, the sewing machine of the present invention comprises a machine bed 1 and an arm 2 mounted thereon.

Installed in the machine bed 1 are a main shaft 3 supported horizontally, a looper 4 moved elliptically thereby, and a cam unit 5 to control feeding length of a looper thread S4 according to the movement of the looper 4. A pulley 6 attached to one end of the main shaft 3 is coupled with the main motor (not shown) to drive the machine by a belt 7.

The arm 2 is equipped with an arm shaft 8 parallel to the main shaft 3 and a needle clamp 10 reciprocating vertically above a sewing area 9 by the rotation of the arm shaft 8. The arm shaft 8 is linked with the main shaft 3 by a belt 11 so that they can rotate synchronously. The needle clamp 10 is provided with, for example, three needles 12*a*, 12*b*, and 12*c*. The top end point is indicated by continuous lines, and the bottom end point by double dashed lines.

The looper 4 is positioned at its left end point as shown in FIG. 1 when the needles 12*a*–12*c* are at their top end point, and at a right end point when the needles are at their bottom end point.

Attached to the front surface of the arm 2 are a thread supply device 13 for forcibly supplying three needle threads S1–S3 to the needles 12*a*–12*c*, a thread tension regulator 14 for supplying the looper 4 with the looper thread S4 applied a specified tension, and thread guide paths 15 for guiding each of the threads S1–S4 along specified paths. As shown in FIG. 1, thread guide 15*a* for the needle threads S1–S3 is provided above the needle clamp 10 and moves up and down with the needles 12*a*–12*c*.

The thread supply device 13 includes a pair of thread supply rollers 16 and 17, and thread clampers 18–20 provided upstream of the rollers. The thread supply rollers 16 and 17 face each other to hold the three needle threads S1–S3 therebetween, and are rotated in opposite directions as the arrows show in FIG. 1 by a roller drive motor 36 which rotates at a certain speed independently of the rotation of the shafts 3 and 8. The thread supply rollers 16 and 17 rotate at a speed corresponding the maximum sewing speed of the sewing machine.

In this embodiment, each of the thread clampers 18–20 respectively has a pair of strip members 18*a*/18*b*–20*a*/20*b* which are bimorph-type piezoelectric elements. They can lock a thread with a force greater than the transporting force of the thread supply rollers 16 and 17 to stop the thread supply, and release the thread so that it can be fed at a high speed by the rotation of the rollers 16 and 17. These operations of clampers are realized by electrifying the bimorph-type piezoelectric elements at opposite phases to each other. Employing the above piezoelectric elements ensures that the thread clamping/releasing operation is performed within a short period.

The detailed construction of the above thread clampers 18–20 is described in Japanese Laid-open Patent Application 4-2394 (Refer to U.S. Ser. No. 07/686518). Although the piezoelectric elements are suitable, various known high-speed actuators may be used instead.

The machine shown in FIG. 1 forms a stitch of a Federal Standard No. Stitch Type 407 by the three needles 12*a*, 12*b*, and 12*c* and a looper 4. However, to simplify the description, the forming operation of a stitch type 401 is described which needs only the needle 12*a* and the looper 4 and is controlled by the thread supply rollers 16 and 17, and the thread clamper 18 of the thread supply device 13.

The clamping timing of the thread clamper 18 according to the present invention is described with reference to FIG. 2.

The axis of abscissa A indicates the rotating angle of the main shaft 3. Rotation through 360° corresponds to one sewing cycle.

Figure 2:
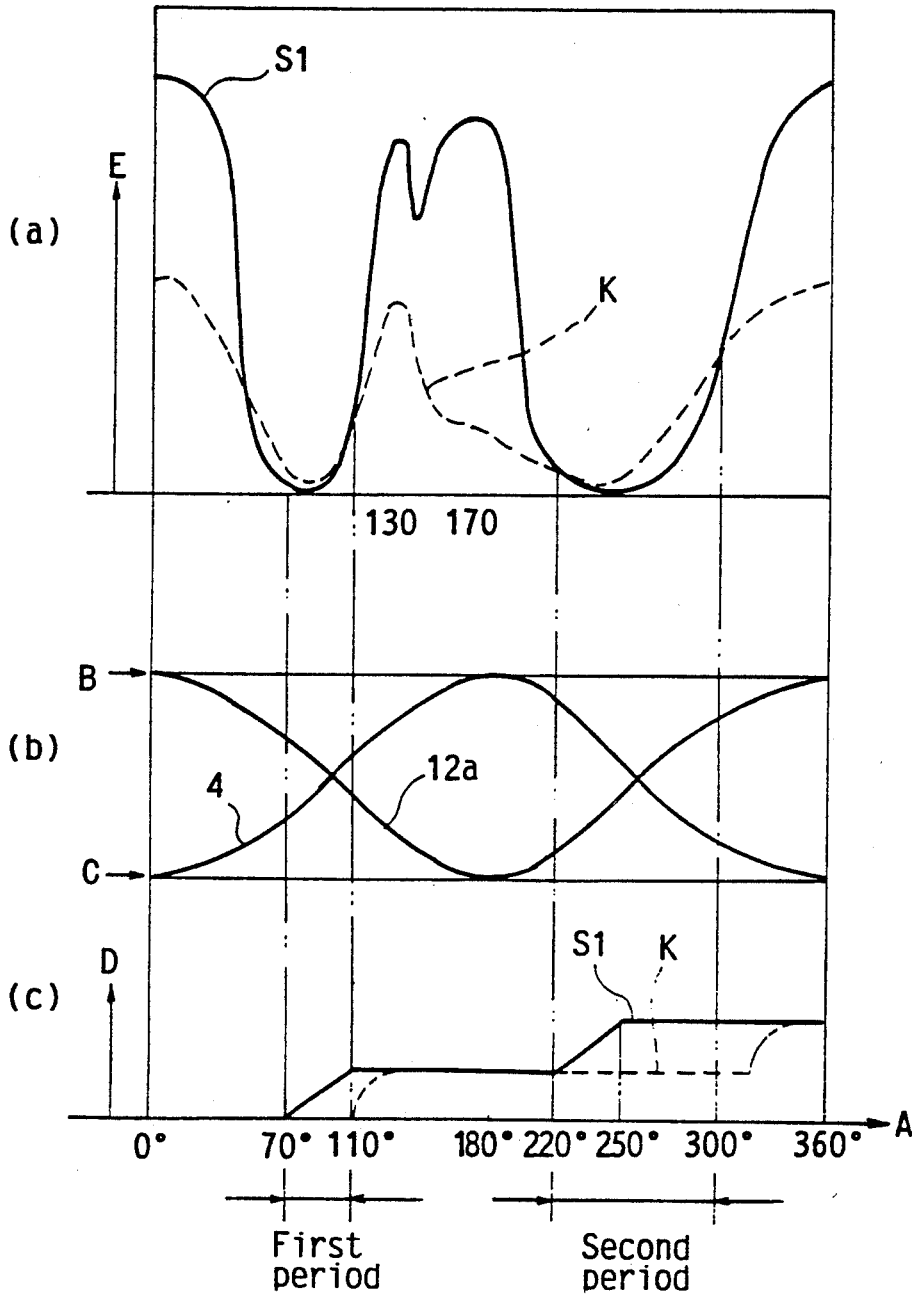
FIGS. 2*a–c* show needle thread tension in accordance with the vertical movement of the needle.

FIG. 2(*a*) shows a graph of thread tension of the needle thread S1 controlled by the thread clamper 18 of this invention indicated by continuous lines, and thread tension of the needle thread K controlled by a conventional thread tension regulator indicated by short dashed lines.

FIG. 2(*b*) is a motion diagram showing vertical movement of the needle 12*a* of the sewing machine shown in FIG. 1 (B: the top end point, C: the bottom end point), and horizontal movement of the looper 4 (B: the left end point, C: the right end point).

FIG. 2(*c*) is a graph showing, the total amount of needle thread supplied in one stitch (the axis supplied to the sewing area 9, with ordinate D) the needle thread S1 of the present invention being indicated by continuous lines and the needle thread K of a conventional example being indicated by short dashed lines.

As shown in FIG. 2(*a*)(*b*), the thread tension of the needle thread K controlled by the conventional thread tension regulator begins to rise when the rotating angle of the main shaft is 90°, reaches a peak at around 130°, falls gradually after that, rises again around 250°, and reaches another peak at around 360° (0°). Responding to the two peaks of the tension, the needle thread K is pulled out of the thread supply source twice, one around 130° and the other around 320° to 340° as shown in FIG. 2(*c*). The amount of thread required for one sewing cycle was conventionally gained by the generation of this tension.

To the contrary, according to this invention, the needle thread S1 is forcibly supplied toward the sewing area 9 within each period at the maximum speed of the sewing machine by making the angle between 70° and 110° a first period, and the one between 220° and 300° a second period. More precisely, the thread clamper 18 is released in the entire first period, and between 220° and 250° in the second period to forcibly supply the required amount of thread for a determined sewing cycle by the thread supply rollers 16 and 17.

Thus, the thread tension of the needle thread S1 shown in FIG. 2(*a*) is generated by supplying an amount of the needle thread required for one sewing stitch in the new period by intentionally dividing the period to supply the thread. In other words, the two peaks around 130° and 360° can be maintained at a higher level than the peak of the conventional needle thread K, and another peak having the same tension as the one around 130° can be generated around 170°.

It is desirable that the peaks around 130° and 170° be maintained as high as, or a little lower than the one around 360°.

The following describes the effectiveness of the high tension of the needle thread S1, which is generated by supplying it forcibly in new periods, in a forming process of a stitch by the needle thread S1 and the looper thread S4, with reference to FIG. 3.

When the rotating angle of the main shaft is 0°, the needle 12*a* is at the top end point and the looper 4 is at the left end point as shown in FIG. 3 (*a*). At this time, since the needle thread has rather high tension, the needle thread S1, the looper thread S4, and the looper 4 form a regular triangle T as shown. The tension of the needle thread S1 continues until immediately before the needle 12*a* enters the triangle T, at which point the rotating angle of the main shaft is around 70°. Consequently, the needle 12*a* can enter the triangle T without fail, causing no skip stitches.

Since the needle 12*a* falls during the angle between 70° and 180° as shown in FIG. 3(*b*)–(*e*), the needle thread S1 is needed to form a stitch. The needle thread S1 is supplied only during the period between 70° and 110°, avoiding an oversupply, to form a seam. As a result, since the needle thread S1 falls during the angle between 110° and 180° without a thread supply, its tension heightens. The tension generated during the period is considered to properly tighten a just formed stitch. The supply of the needle thread S1 is suspended until the angle reaches 220°, thereby continuing to tighten the seam.

When the angle has reached 220°, the looper 4 enters a loop of the needle thread S1 generated by the needle 12*a* rising from the bottom end point as shown in FIG. 3(*f*). During the angle between 220° and 360° (=0°), the looper 4 moves to the left with the needle thread S1 hooked, and the needle 12*a* rises to the top end point. Since the needle thread S1 is needed to form stitches, it is supplied between 220° and a predetermined angle (250° in this embodiment). During the angle between 250° and 70°, the tension of the needle thread S1 is increased by suspending the supply of the needle thread S1, forming the above mentioned regular triangle T.

The following is a description of a control system to supply the needle thread S1 only during the first and second periods as above to obtain good sewing results, with reference to FIGS. 4–7.

Figure 4:
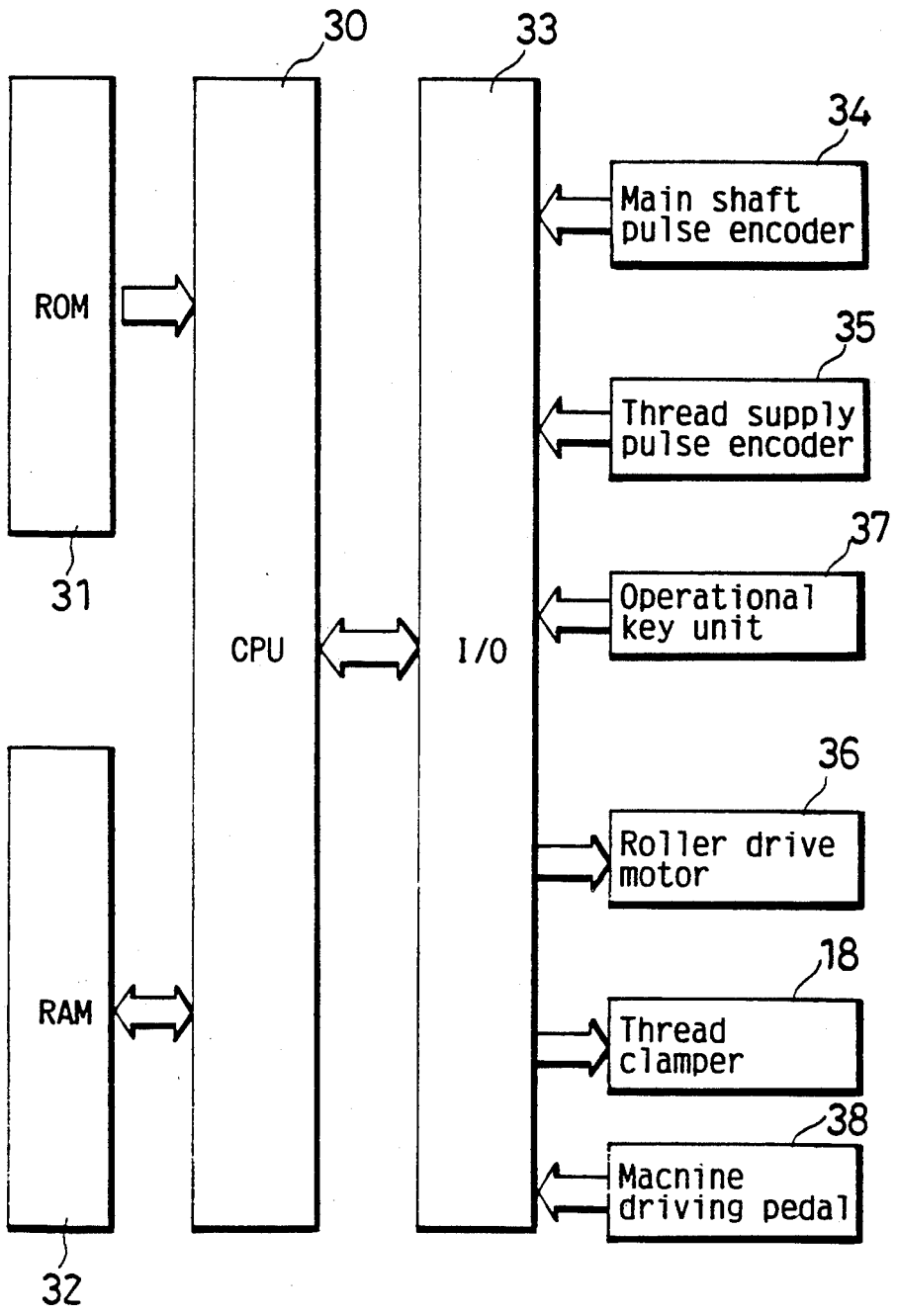
FIG. 4 shows a hard ware construction as its control device to control their thread supplying apparatus.

In FIG. 4, there are a CPU 30, a ROM 31, a RAM 32, an I/O device 33, and a main shaft pulse encoder 34 provided to the main shaft 3.

The main shaft pulse encoder 34 generates one pulse every time the main shaft 3 rotates a determined angle (hereinafter referred to as a rotation pulse), and another pulse, every time the angle becomes 0° (hereinafter referred to as original pulse).

A thread supply pulse encoder 35 built in the thread supply roller 16 generates further another pulse every time the roller 16 rotates a determined angle (hereinafter referred to as a thread supply pulse).

An operational key unit 37 is used to set the pulse number N1 of the thread supply pulse encoder 35 corresponding to the amount of thread supplied in the first period, the pulse number N2 of the encoder 35 corresponding to that in the second period, the main shaft rotating angle (70° and 220°) to start the opening operation of the thread clamper 18, and the angle (110° and 250°) to quit the opening operation of the clamper 18.

A machine driving pedal 38 is used to control the rotating speed of the main motor by changing its stepping force.

Figure 5:
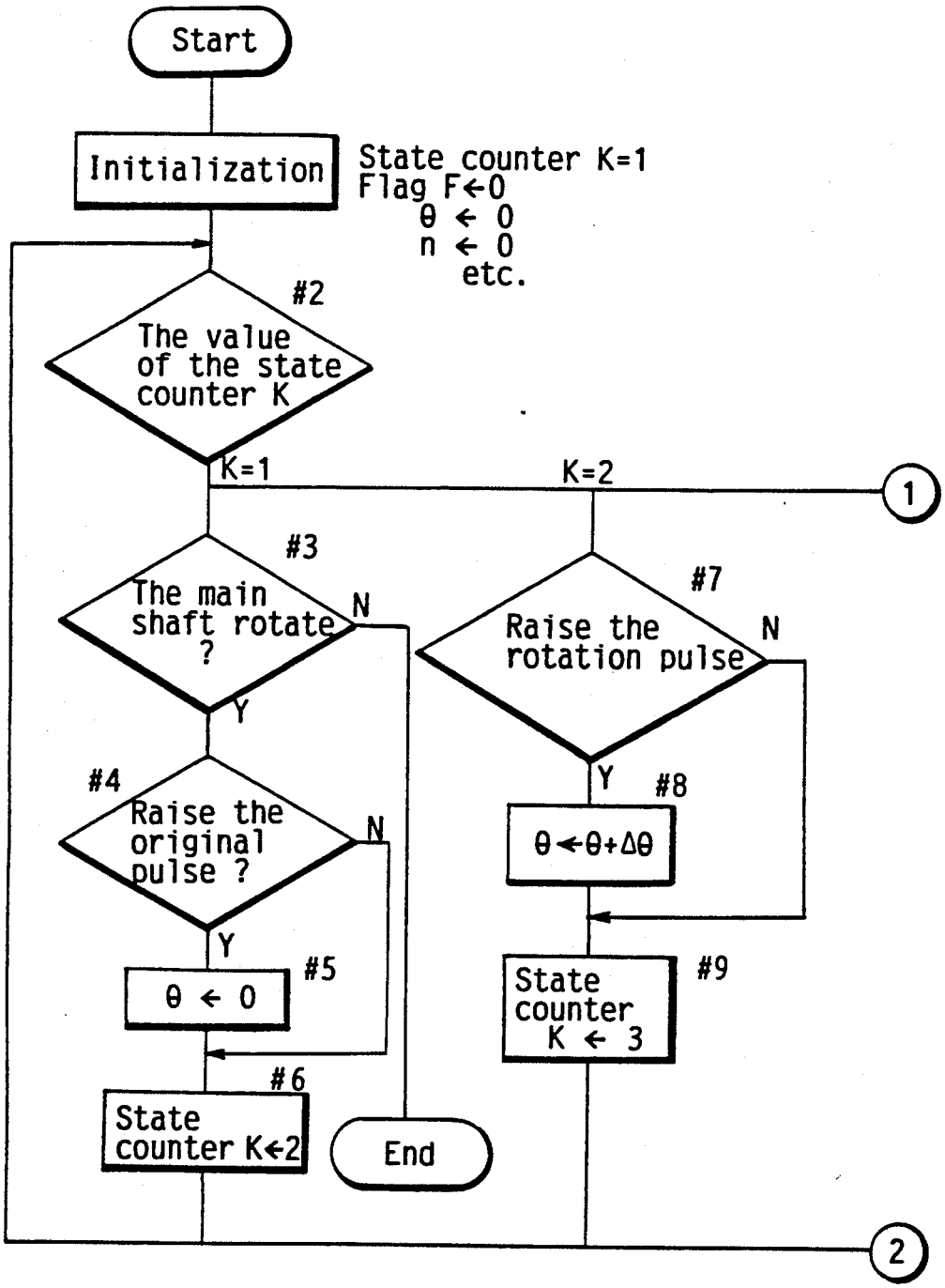
FIG. 5 shows a flow chart explaining operations of the construction shown in FIG. 4.
Figure 6:
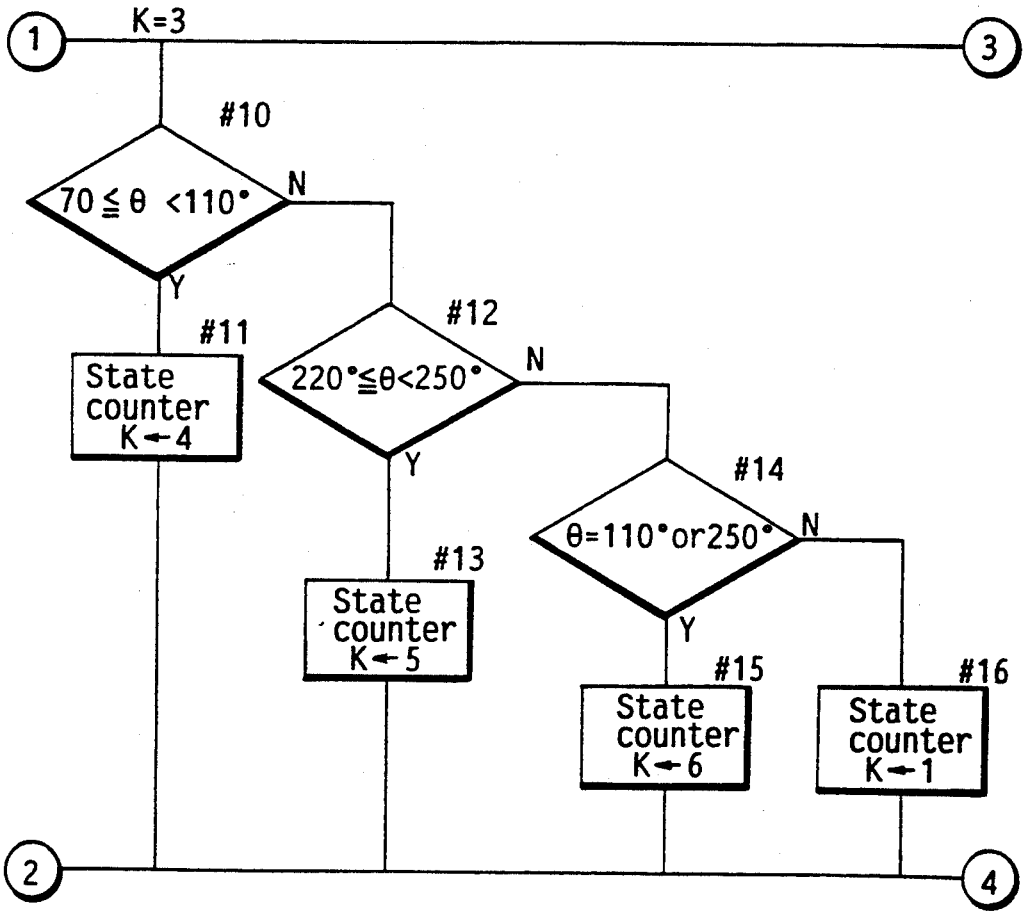
FIG. 6 shows a flow chart explaining operations of the construction shown in FIG. 4.
Figure 7:
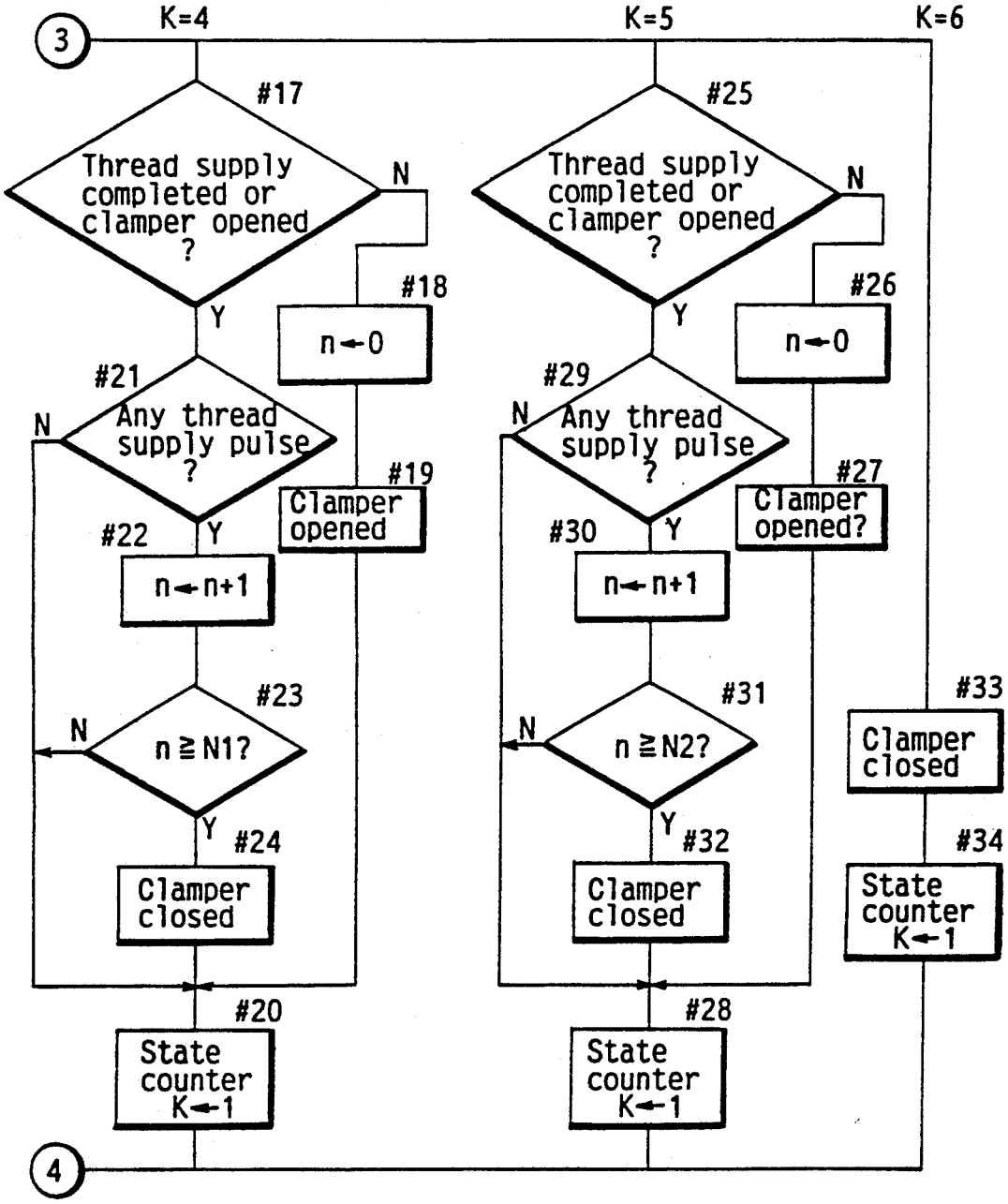
FIG. 7 shows a flow chart explaining operations of the construction shown in FIG. 4.

As shown in FIGS. 5–7, at first, the CPU is initialized (#1) followed by necessary operations including closing the thread clamper 18, admitting pulses from the main shaft pulse encoder 34, clearing the thread supply pulse counter n which counts the number of thread supply pulses outputted from the L thread supply pulse encoder 35 and a register $\theta$ which holds the rotating angle of the main shaft, and setting a state counter K to 1. The register $\theta$, thread supply pulse counter n, and the state counter K are built in the CPU 30.

The state counter K to operate depending on each control state can take any value of from 1 to 6. When the value is 1, the operations in #3–#6 are performed. When it is 2, #7–#9. When it is 3, #10–#16. When it is 4, #17–#24. When it is 5, #25–#32. When it is 6, #33 and #34. A value of the state counter K is shifted to another value to perform a next operation at #6, #9, #11, #13, #15, #16, #20, #28, and #34. The value of the state counter is checked at #2. Since the state counter K has its value set to 1 immediately after the CPU is initialized, the operation proceeds to #3 to judge if the main shaft 3 is rotating or not. This judgement is done either by using a rotating sensor to detect the rotation of the main motor or by detecting the operation of the machine driving pedal 38.

When the main shaft 3 is judged not to be rotating, the supplying operation of the needle thread S1 is terminated. When it is rotating, the original pulse from the main shaft pulse encoder 34 is checked if it has been raised (#4), and the register $\theta$ is cleared (#5). If it has not been raised, the value of the state counter K is set to 2 (#6), and then the operation is returned to #2. If it is judged that the value has been set to 2 at #2, the operation proceeds to #7 to check if the rotating pulse from the main shaft pulse encoder 34 has been raised or not, and the value of the register $\theta$ is updated to $\theta+\Delta\theta$ (#8). If it has not been raised, the operation is returned to #2 after the value of the state counter K is set to 3 (#9). If it is judged that the value has been set to 3 at #2, the value of the register $\theta$ is judged at or after #10, and the corresponding value is set to the state counter K as follows.

When $70° \leqq \theta < 110°$ (#10), the value of the state counter K is set to 4 (#11).

When $220° \leqq \theta < 250°$ (#12), the value of the state counter K is set to 5 (#13).

When $\theta = 110°$ or 250° (190 14), the value of the state counter K is set to 6 (#15).

When the value of the register $\theta$ is other than the above, the value of the state counter K is set to 1 to repeat the operations in #3–#16 (#16).

If the value of the state counter K is set at #11, #13, #15, or #16, the operation is returned to #2.

When the value of the state counter K is set to 4 at #11 ($70° \leqq \theta < 110°$), the operation proceeds to #17 via #2 to control a thread supply of the first period as follows.

At first, it is judged if the thread supplying operation is completed or the thread clamper 18 is opened (#17). When the thread clamper 18 is closed and not supplied yet, it is opened after the thread supply pulse counter n is set to 0 (#18), which starts supplying the needle thread S1 with the thread supply roller 16. After that, the state counter K is set to 1 (#20), and the operations in #3–#6, #7–#9, #10, and #11 are performed to resume the operation in #17.

Since the thread clamper 18 is opened at the second operation in #17, the operation proceeds to #21 to detect the thread supply pulse of the thread supply pulse encoder 35.

When it has been detected, the value of the thread supply pulse counter n is increased by 1 (#22). When the value has reached N1 (#23), the thread clamper 18 is closed (#24) to terminate the thread supply control in the first period, and then the state counter K is set to 1 (#20) to return to #2.

On the other hand, if the thread pulse is not detected at #21 or the value n of the thread supply pulse counter has not reached N1 at #23, the state counter K is set to 1 (#20) without closing the thread clamper 18 to return to #2. After this, the same operation is repeated until the counter reaches N1. If it is detected that the rotating pulse of the main shaft pulse encoder 34 has been raised at #7 during the time, the value of the register $\theta$ is updated to $\theta+\Delta\theta$ as above (#8).

After the value of the state counter K is set to 5 at #12 ($220° \leqq \theta < 250°$), the operation proceeds to #25 via #2 to control thread supply at the second period.

The control is not described because it includes the same operations as those in #17–24 except that the judged value of the thread supply pulse counter is N2.

Usually, the period for the thread supply pulse counter n to count N1 or N2 pulses is shorter than the first period ($70° \leqq \theta < 110°$) or the second period ($220° \leqq \theta < 250°$) respectively. However, if the rotating angle of the main shaft reaches 110° or 250° for some reason, before counting these pulses, it is not desirable to continue supplying the thread. Therefore, the supply is forcibly stopped by the judgement in 190 14 and the operations in #15, #33, and #34 in this embodiment.

Although FIGS. 4–7 show the system to control the thread clamper 18 only, the other thread clamper 19 and 20 can be controlled in the same manner just by changing the timing of starting and ending of the first and second periods according to the paths of the needle threads S2 and S3, to obtain good sewing results.

This embodiment is applicable also to an over-edging stitching machine for a stitch type 505 in addition to the stitch type 407. Since the type 505 used for a blindstitch hemming needs more threads than the ordinary over-edging stitching, the seam, which can not be stable in conventional control, can be stable by this invention.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A method for supplying thread in a chain stitch sewing machine which has an apparatus for forcibly supplying a needle with a needle thread for forming a stitch, the method comprising:

reciprocally moving the needle in a sewing cycle form a top end point to a bottom end point and back;

supplying a first predetermined amount of needle thread to the needle in a first period of the sewing cycle before the needle reaches the bottom end point;

stopping the supply of the needle thread when the first predetermined amount has been supplied, so that increased tension is applied to the needle thread by the movement of the needle;

supplying a second predetermined amount of the needle thread to the needle in a second period of the sewing cycle after the needle departs from the bottom end point; and stopping the supply of the needle thread when the supplying of the second predetermined amount has been completed, before the needle reaches the top end point.

2. A method for supplying thread of claim 13, wherein the first period in each sewing cycle is from the time the needle begins to enter a triangle formed by a looper, a looper thread and the needle thread, to the time the tip of a looper begins to leave the needle, and the second period in each sewing cycle is from the time the looper begins to enter the loop formed by the needle thread while the needle is rising from a bottom end point, to the time the needle reaches a predetermined height.

3. A method for supplying thread of claim 13, wherein the supply of the needle thread is locked during periods other than the periods of forcibly supplying the needle thread.

4. A chain stitch sewing machine, comprising:

a needle which vertically reciprocates between a tope nd point and a bottom end point in a sewing cycle;

a looper which reciprocates horizontally in one sewing cycle;

a thread supplier for forcibly supplying a needle thread to the needle; and a thread supply controller for controlling the thread supplier to supply a first predetermined amount of needle thread in a first period of one sewing cycle before the needle reaches the bottom end point and to stop the supply of the needle thread when the first predetermined amount is supplied so that increased tension is applied to the needle thread with movement of the needle, and to supply a second predetermined amount of the needle thread in a second period of the sewing cycle after the needle departs from the bottom end point and to stop the supply of the needle thread when the second predetermined amount is supplied before the needle reaches the top end point.

5. A chain stitch sewing machine of claim 4, wherein the first period in each cycle is from the time the tip of the falling needle begins to cross the tip of the looper to the time the tip of the looper begins to leave the needle, and the second period in each cycle is from the time the looper begins to enter the loop formed by the needle thread while the needle is rising from the bottom end point to the time the needle reaches a predetermined height.

6. A chain stitch sewing machine of claim 5, further comprising:

lock means for locking the supply of the needle thread; and thread lock control means for controlling the lock means so that the supply of the needle thread is locked during periods other than the periods of forcibly supplying the needle thread.

7. A chain stitch sewing machine of claim 6, wherein the thread supply means can supply more thread than a predetermined amount in each period, and the thread lock control means makes the lock means lock the supply when the supplied thread has reached the predetermined amount in each period of forcibly supplying thread.

8. A chain stitch sewing machine of claim 6, wherein the lock means is provided upstream of the thread supply means in the supplying direction and stops the supply of the needle thread by applying a greater restraining force than the transporting force of the thread supply means.

9. A chain stitch sewing machine of claim 6, wherein the lock means has a pair of clamping members for clamping the needle thread therebetween.

10. A chain stitch sewing machine of claim 9, wherein the pair of clamping members has a pair of piezoelectric elements which open and close the gap between the members according to impressed voltage, and the thread lock control means controls the voltage impressed on the piezoelectric elements.

11. A chain stitch sewing machine of claim 4, wherein the thread supply means has a pair of rollers to transport the needle thread therebetween.

12. A chain stitch sewing machine of claim 11, wherein the pair of rollers is driven independently of the needle and the looper.

13. A chain stitch sewing machine of claim 4, further comprising a thread guide for the needle which vertically reciprocates with the needle.

* * * * *